US007686630B2

(12) United States Patent
Takehara et al.

(10) Patent No.: US 7,686,630 B2
(45) Date of Patent: Mar. 30, 2010

(54) CONNECTOR INCLUDING FOREIGN BODY PREVENTING UNIT INCLUDING BLOCKING SHEET MEMBER AND LOCKING UNIT

(75) Inventors: Hideaki Takehara, Hitachi (JP); Sachio Suzuki, Hitachi (JP); Kunihiro Fukuda, Tsukuba (JP); Yuta Kataoka, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 12/379,990

(22) Filed: Mar. 5, 2009

(65) Prior Publication Data

US 2009/0311899 A1 Dec. 17, 2009

(30) Foreign Application Priority Data

Jun. 12, 2008 (JP) ..... 2008-154694

(51) Int. Cl.
*H01R 13/44* (2006.01)

(52) U.S. Cl. ..... 439/140

(58) Field of Classification Search ..... 439/137, 439/139, 140, 141
See application file for complete search history.

(56) References Cited

U.S. PATENT DOCUMENTS 6,623,285 B2 * 9/2003 Nishide ..... 439/140
6,846,191 B2 * 1/2005 Hobbs et al. ..... 439/140
7,267,562 B2 * 9/2007 Katsuma ..... 439/140

FOREIGN PATENT DOCUMENTS

JP 2001-35589 2/2001

* cited by examiner

*Primary Examiner*—Tho D Ta
(74) *Attorney, Agent, or Firm*—McGinn IP Law Group, PLLC

(57) ABSTRACT

A connector includes a male connector including plural male terminals, a first body provided with the plural male terminals, and a first terminal housing formed with a first housing opening facing respective ends of the plural male terminals, and a female connector including plural female terminals paired with the plural male terminals, a female terminal box formed with plural female terminal openings facing ends of the plural female terminals respectively, and a second body provided with the plural female terminals and the female terminal box. The connector further includes foreign body preventing means for preventing a foreign body from being mixed into the specified receiving space of the first terminal housing. The foreign body preventing means includes a blocking sheet member enclosed in the specified receiving space of the first terminal housing for blocking or substantially blocking the first housing opening, and plural male terminal openings through which the male terminals pass at specified positions respectively in the blocking sheet member.

10 Claims, 8 Drawing Sheets

<WHEN INSERTED>

<WHEN DETACHED>

CONNECTOR INCLUDING FOREIGN BODY PREVENTING UNIT INCLUDING BLOCKING SHEET MEMBER AND LOCKING UNIT

The present application is based on Japanese patent application No. 2008-154694 filed Jun. 12, 2008, the entire contents of which are incorporated herein by reference.

BACKGROUND OF THE INVENTION

1. Field of the Invention

The present invention relates to a connector, which has a high possibility of being used in a large-capacity wire harness used where large-capacity power transmission is desired in hybrid vehicles, electric vehicles, and the like.

2. Description of the Related Art

In hybrid vehicles, electric vehicles, and the like having achieved a remarkable improvement in recent years, a large-capacity wire harness connecting a motor and an inverter is provided with a multipolar connector at one end having three three-phase AC power wires aggregated therein. The power wires have become larger-sized with higher motor power. For example, in order to enhance rigidity, the entire structure of the connector provided at one end of the wire harness has consequently tended to be large-sized.

This is disadvantageous in making products compact and lightweight. To improve such tendencies in recent years, there are market needs for a large-capacity wire harness connector, which is compact or is prevented as much as possible from being large-sized.

Refer to JP-A-2001-35589, for example.

In the above background, there is a new problem below.

That is, there is a possibility of foreign bodies such as screws (or dust) being mixed in a male-connector housing placed on an device side of the wire harness connector (halved into a male and a female connector), and rendering complete engagement and connection between the male connector and female connector impossible. In the female connector which is on the wire side, even if foreign bodies such as screws are mixed therein, they are easily noticeable and removable.

Accordingly, the present inventors have considered a foreign body preventing means, as a shutter structure, which completely covers an opening of the male-connector housing, and blocks that housing opening when in complete disengagement and disconnection between the male and female.

However, the above-considered shutter structure causes its opening/closing mechanism to be attached outside the housing (to the surface of the housing), and therefore makes the connector larger than conventional products, and goes against the recent years' market needs as mentioned above. A further improvement is desired.

SUMMARY OF THE INVENTION

Accordingly, it is an object of the present invention to provide a compact connector, which can contribute to the compact thereof even though a foreign body preventing means is provided.

(1) According to one embodiment of the invention, a connector comprises:

a male connector comprising a male terminal arranged substantially linearly, a first body provided with the male terminal, and a first terminal housing formed with a first housing opening facing an end of the male terminal and receiving the male terminal in its specified receiving space and incorporating the first body therein;

a female connector comprising a female terminal paired with the male terminal, a female terminal box formed with a female terminal opening facing an end of the female terminal and receiving the female terminal in its specified receiving space, and a second body provided with the female terminal and the female terminal box, the engagement of the male connector and the female connector, or the first terminal housing and the second terminal housing electrically connecting the male terminal and the female terminal; and foreign body preventing means for preventing a foreign body from being mixed into the specified receiving space of the first terminal housing, the foreign body preventing means comprising a blocking sheet member enclosed in the specified receiving space of the first terminal housing for blocking or substantially blocking the first housing opening, and a male terminal opening through which the male terminal passes at a specified position in the blocking sheet member, wherein when the female terminal box is inserted into the specified receiving space of the first terminal housing, the blocking member is interlocked with that insertion to cause the male terminal to pass through the male terminal opening and the blocking member to slide toward the first body, while when the female terminal box is detached from the specified receiving space of the first terminal housing, the blocking member is interlocked with that detachment to slide toward the first housing opening.

In the above embodiment (1), the following modifications and changes can be made.

(i) The male terminal comprises a plurality of male terminals, and the female terminal comprises female terminals of the same number as the plurality of male terminals.

(ii) The foreign body preventing means further comprises a female locking means provided at both ends of the female terminal box of the female connector for locking the blocking member of the male connector, and a male locking means provided at both ends of the blocking member of the male connector and engaged with the female locking means for locking the female terminal box of the female connector, the male locking means and the female locking means locking the blocking member and the female terminal box, thereby causing the male terminal openings of the blocking member and the female terminal openings of the female terminal box to be arranged in pairs.

(iii) The male locking means comprises a first lance formed on a side of the blocking member and toward the first housing opening, and a first protruding portion formed at an end of the first lance, and the female locking means comprises a locking piece formed with an opening for engaging the first protruding portion, and a second protruding portion for, when engaging the male locking means, bending the first lance toward the locking piece and causing the first protruding portion to engage the opening.

(iv) The connector further comprises:

movement-prohibiting means for, prior to locking of the blocking member and the female terminal box by-the male locking means and the female locking means, prohibiting the blocking member from sliding toward the first body from the end of the male terminal; and movement-permitting means for permitting movement of the blocking member when the blocking member and the female terminal box are locked by the male locking means and the female locking means.

(v) The connector further comprises:

movement-prohibiting means for, prior to locking of the blocking member and the female terminal box by the male locking means and the female locking means, prohibiting the blocking member from sliding toward the first body from the end of the male terminal; and movement-permitting means for permitting movement of the blocking member when the blocking member and the female terminal box are locked by the male locking means and the female locking means, wherein the movement-prohibiting means comprises a third protruding portion formed at an end of the first lance for locking ends of the male terminals, and the movement-permitting means comprises a second protruding portion, and when engaged with the male locking means, the second protruding portion bends the first lance in a direction of unlocking the third protruding portion and causing the first protruding portion to engage the opening.

(vi) The connector further comprises:

engagement-maintaining means for maintaining engagement of the male locking means and the female locking means when the male locking means and the female locking means lock the blocking member and the female terminal box, and the blocking member is caused to slide toward the first body.

(vii) The connector further comprises:

slip-preventing means for preventing the blocking member from slipping out of the ends of the male terminals.

(viii) The slip-preventing means comprises a second lance formed on the backside of the blocking member and toward the first body, a fifth protruding portion formed at an end of the second lance and upright to the male terminals, and a sixth protruding portion formed at the ends of the male terminals and locked with the fifth protruding portion.

(ix) The farthest ends of the male terminals are positioned on an inner side to the male terminal opening of the blocking member before the female terminal box is inserted into the specified receiving space of the first terminal housing, and when the blocking member is positioned at the ends of the male terminals.

(x) The connector further comprises:

an air escape opening for causing the air inside the specified receiving space of the first terminal housing to escape therefrom when the blocking member blocks or substantially blocks the first housing opening.

Advantages

According to the invention, it is possible to ensure a compact connector, which can contribute to the compact thereof even though a foreign body preventing means is provided.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
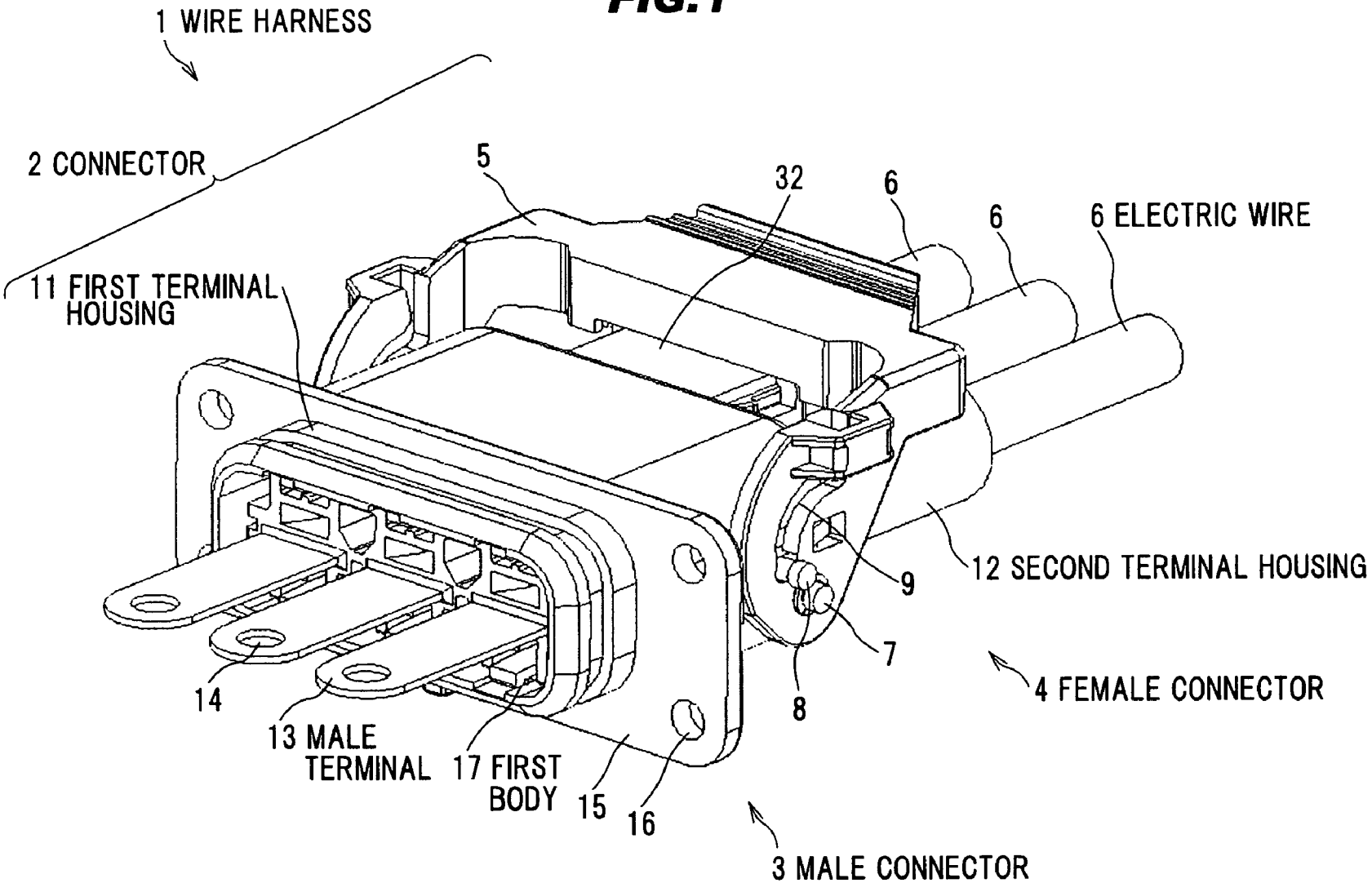
FIG. 1 is an entire perspective view illustrating a wire harness 1 with a connector 2 in embodiment 1 according to the present invention.
Figure 2:
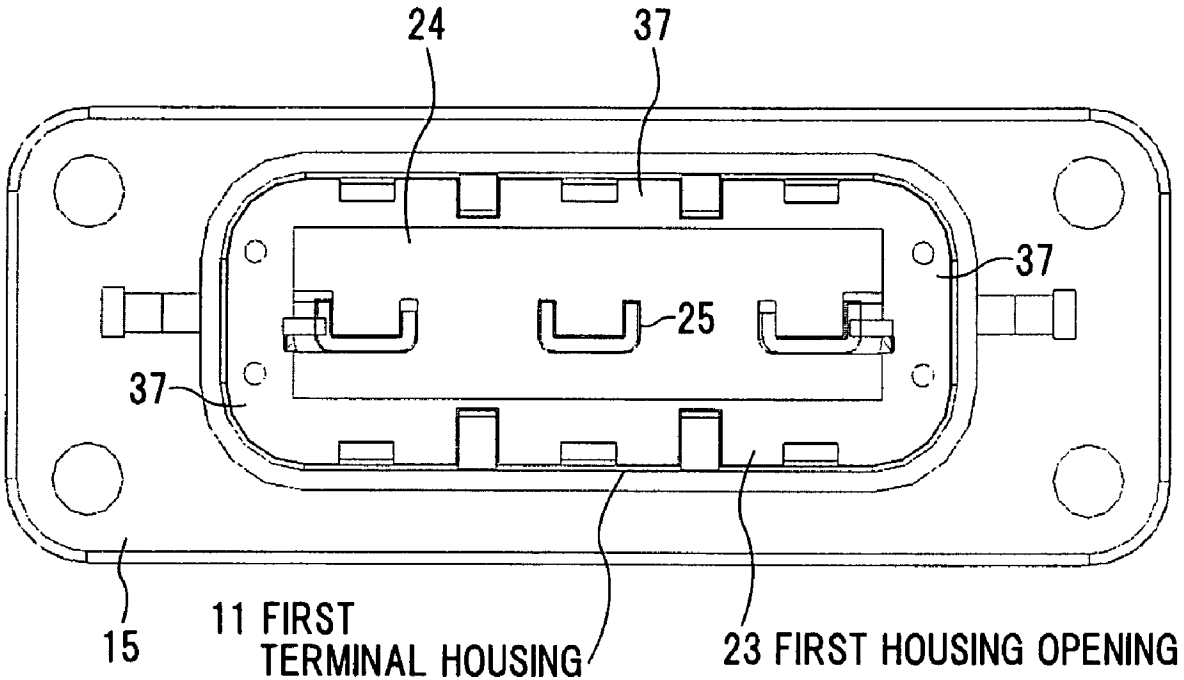
FIG. 2 is a front view illustrating a first housing opening 23 in a male connector 3 of the connector 2 in embodiment 1 according to the present invention.
Figure 3:
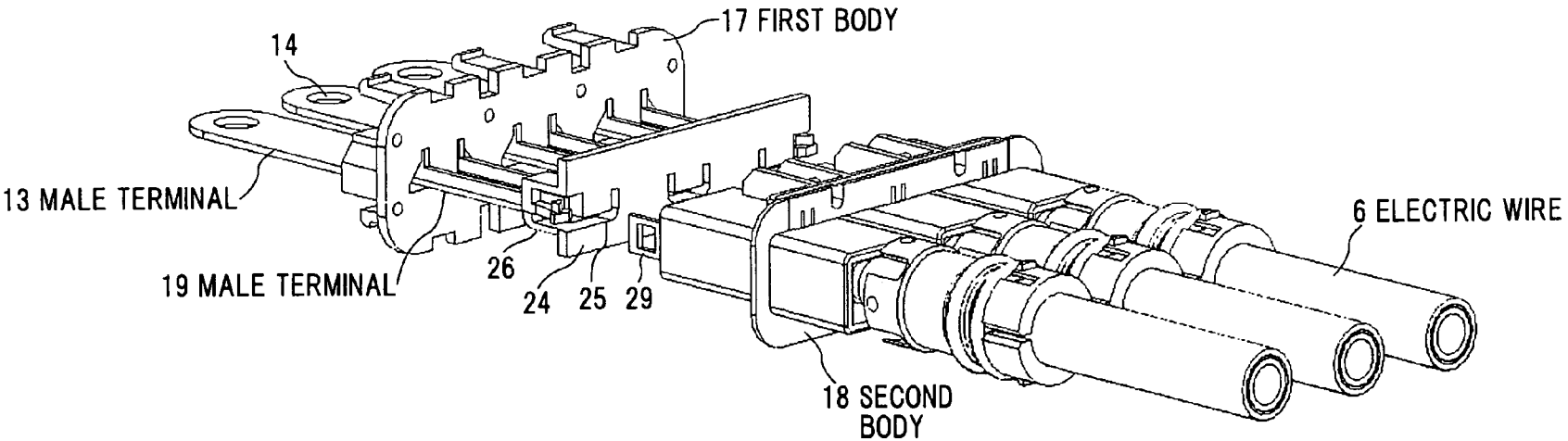
FIG. 3 is an entire explanatory view for explaining entire operation of a foreign body preventing means in the connector 2 in embodiment 1 according to the present invention.
Figure 4:
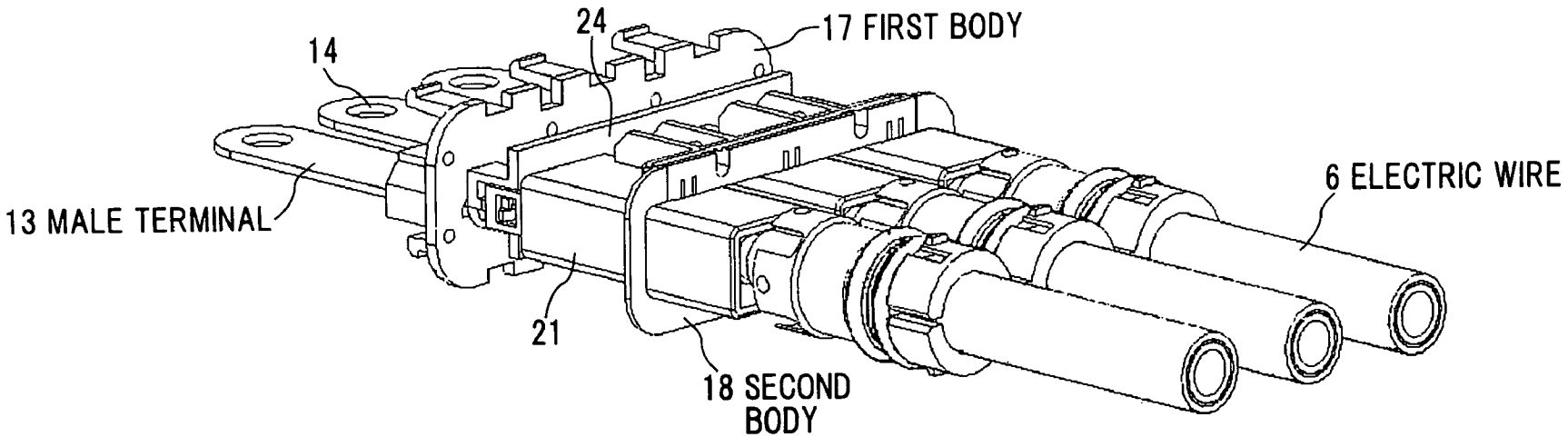
FIG. 4 is an entire explanatory view for explaining entire operation of the foreign body preventing means in the connector 2 in embodiment 1 according to the present invention.
Figure 5:
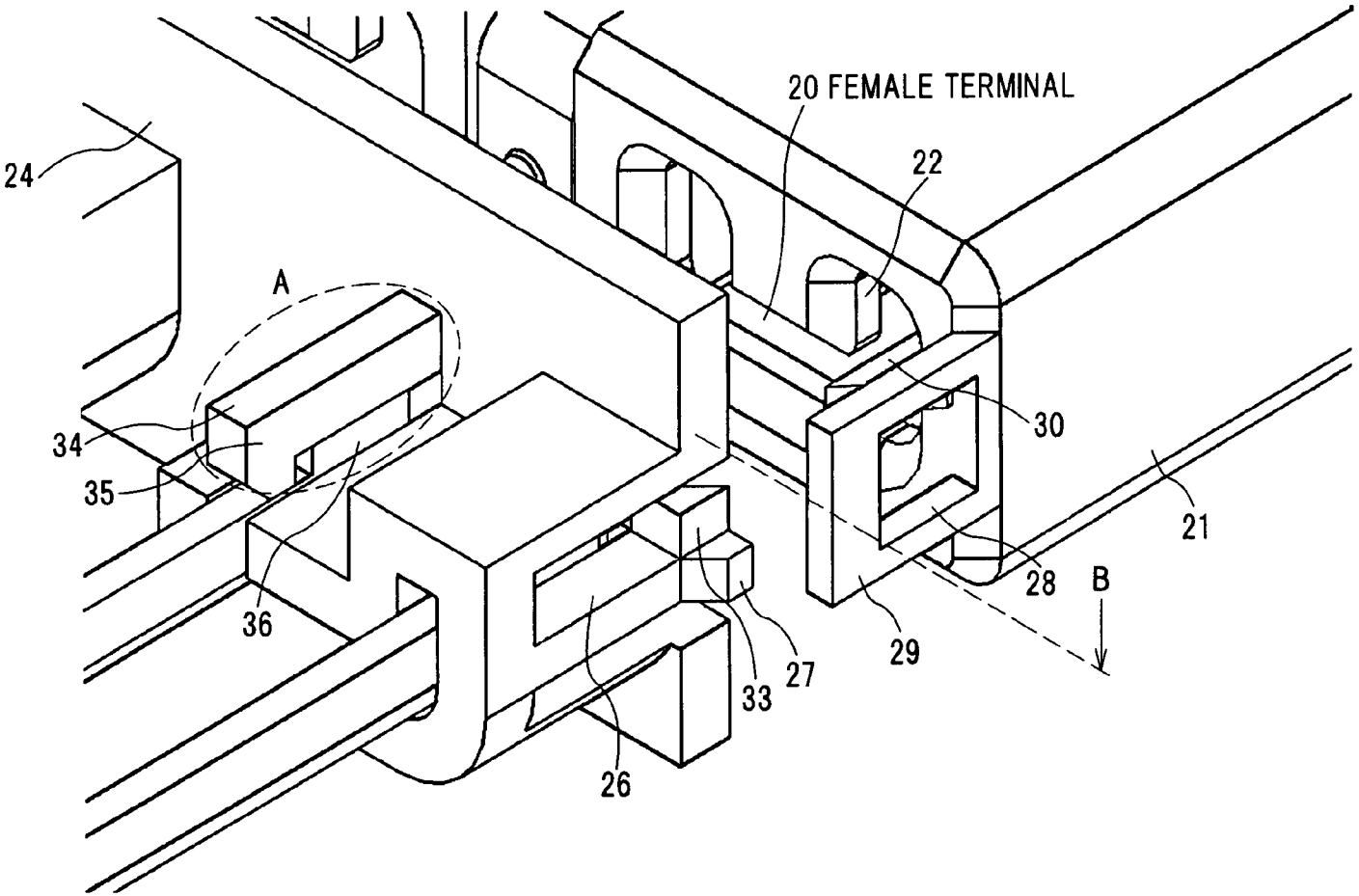
FIG. 5 is a partially enlarged view for explaining a portion of the foreign body preventing means in the connector 2 in embodiment 1 according to the present invention.
Figure 6:
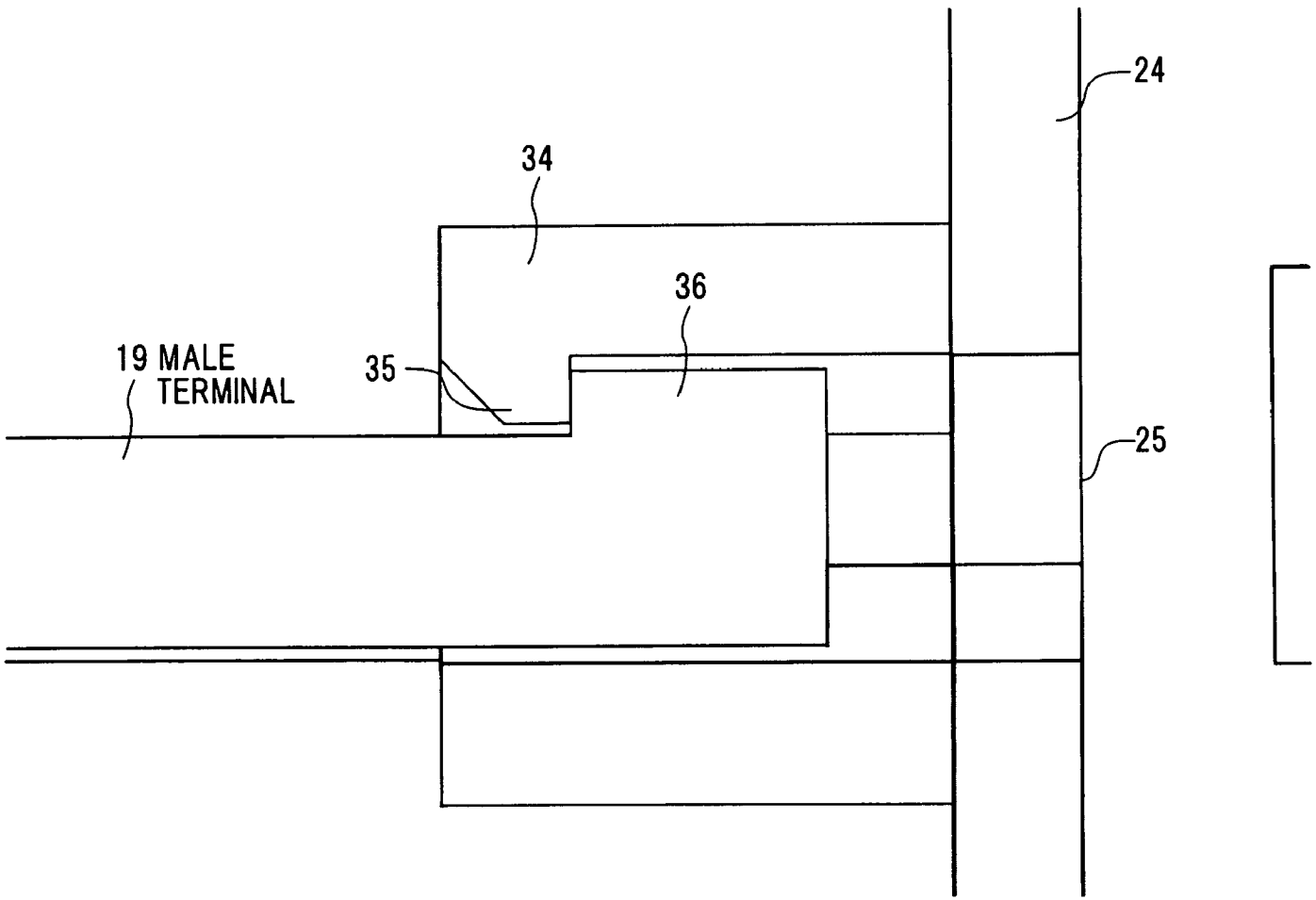
FIG. 6 is a side cross-sectional view for explaining an elliptical portion A indicated by a broken curve in FIG. 5.
Figure 7:
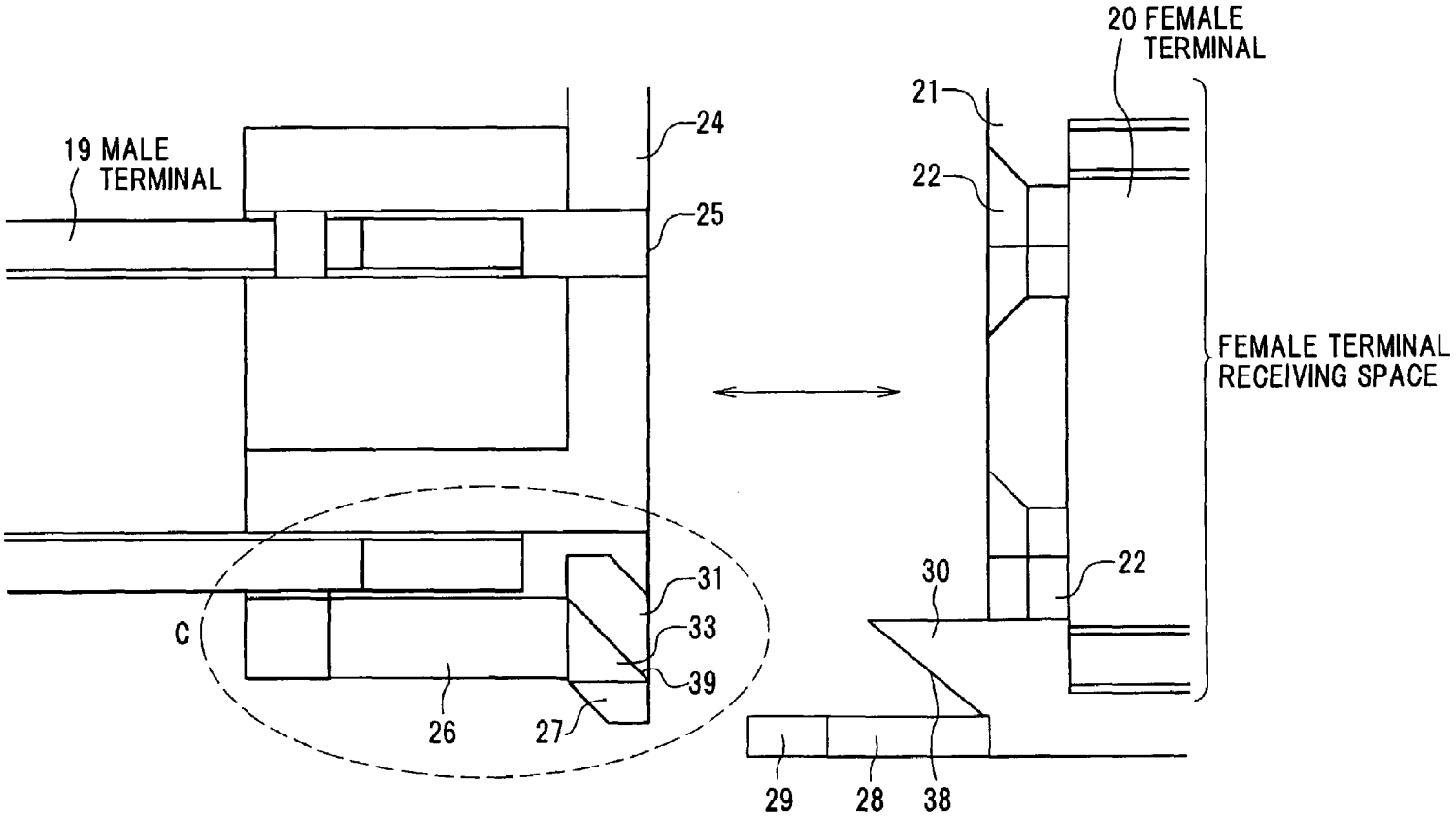
FIG. 7 is a plan cross-sectional view illustrating a horizontal cross-sectional portion including a straight line B indicated by a broken line in FIG. 5.
Figure 8A:
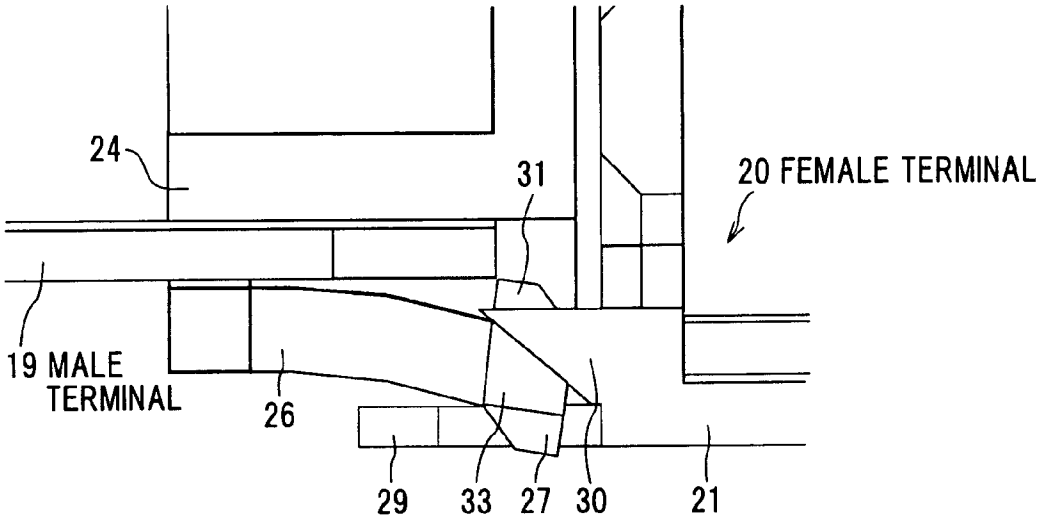
FIG. 8A is an explanatory view for explaining operation in an elliptical portion C indicated by a broken curve in FIG. 7.
Figure 8B:
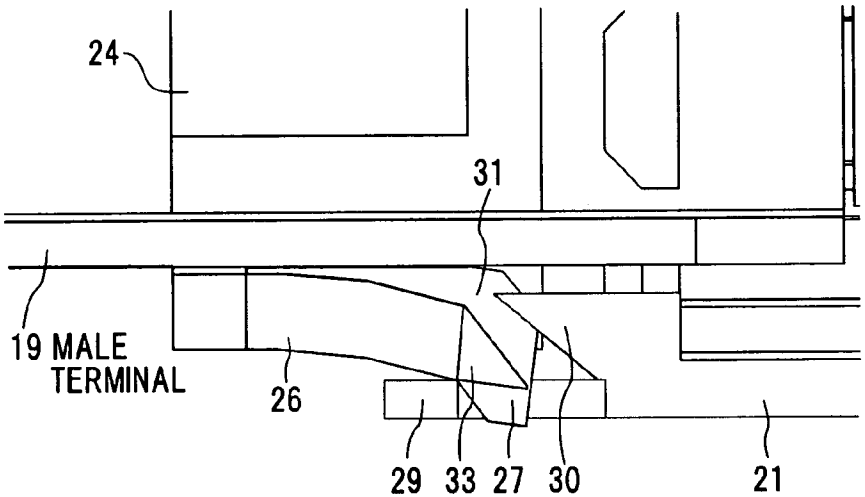
FIG. 8B is an explanatory view illustrating the backside of FIG. 8A.

FIG. 1 is an entire perspective view illustrating a wire harness 1 with a connector 2 in embodiment 1 according to the present invention. FIG. 2 is a front view illustrating a first housing opening 23 in a male connector 3 of the connector 2 in embodiment 1 according to the present invention. FIG. 3 is an entire explanatory view for explaining entire operation of a foreign body preventing means in the connector 2 in embodiment 1 according to the present invention. FIG. 4 is an entire explanatory view for explaining entire operation of the foreign body preventing means in the connector 2 in embodiment 1 according to the present invention. FIG. 5 is a partially enlarged view for explaining a portion of the foreign body preventing means in the connector 2 in embodiment 1 according to the present invention. FIG. 6 is a side cross-sectional view for explaining an elliptical portion A indicated by a broken curve in FIG. 5. FIG. 7 is a plan cross-sectional view illustrating a horizontal cross-sectional portion including a straight line B indicated by a broken line in FIG. 5. FIG. 8A is an explanatory view for explaining operation in an elliptical portion C indicated by a broken curve in FIG. 7. FIG. 8B is an explanatory view illustrating the backside of FIG. 8A.

In FIGS. 3 and 4, in order to explain the invention in detail, for convenience, a first terminal housing 11, which is a chassis of male connector 3, and a second terminal housing 12, which is a chassis of female connector 4, are omitted.

As shown in FIG. 1, connector 2 in embodiment 1 according to the invention is provided at one end of wire harness 1. Male connector 3 and female connector 4 are engaged with each other, to electrically connect male terminal 19 and female terminal 20 paired therewith in the connectors 3 and 4 respectively.

The wire harness 1 can reduce toxic exhaust gas, and is used in connection between a motor and inverter for driving an HEV (Hybrid Electric Vehicle) having a significant fuel reduction effect. Some HEV system can conduct a large-capacitive current of not less than 100 A.

Engagement and disengagement of the male connector 3 and female connector 4, i.e., attachment and detachment of the male connector 3 from the female connector 4 (and vice versa), is performed by rotating a rotary lever 5 about a rotary shaft 7. The male connector 3 and female connector 4 are engaged with each other when the rotary lever 5 is at a specified position of locking portion 32, as shown in FIG. 1, while the male connector 3 and female connector 4 are disengaged when the rotary lever 5 is disengaged from the position of the locking portion 32, as shown in FIG. 1. The operation mechanism of the rotary lever 5 is accomplished by rotary shaft 7, slide shaft 8, curved slide hole 9, and straight slide hole (not shown, formed at both ends of the first terminal housing 11 of the male connector 3).

The male connector 3 will be explained below.

As shown in FIG. 3, the male connector 3 comprises three male terminals 19 (three poles) arranged substantially linearly, a first body 17 provided with the three male terminals 19 and received in a specified receiving space of the first terminal housing 11, and the first terminal housing 11 (See FIG. 1) formed with first housing opening 23 (See FIG. 2) facing the respective ends of the three male terminals 19 and receiving the three male terminals 19 and the first body 17 in its specified receiving space.

Also, each of the three male terminals 19 faces the first housing opening 23 at one end and is connected at the other end to device-side arc and sheet male terminal 13 formed with device-connected hole 14 (in practice, the male terminals 19 and the device-side male terminal 13 are integrally formed of the same member). This device-side male terminal 13 is connected to an inverter side.

The end of the above male terminals 19 which is inserted into female terminal 20 (See FIG. 5) has a cross section formed in a substantially U-shape, as shown in FIGS. 2, 3 and 5. This is because of enlarging the cross section and surface area, and contributes to a reduction in terminal resistance, a reduction in heat generated during electrical conduction, and an enhancement in thermal radiation property during electrical conduction. Also, it has the effect of preventing damage and deformation of first body 17 formed of resin provided with the male terminals 19.

Also, the first body 17 is formed of resin, incorporated in the substantially cylindrical first terminal housing 11, and provided with the three male terminals substantially linearly at a specified pitch.

Also, the first terminal housing 11 is cylindrically formed of a metal, e.g., aluminum, and its internal space is formed as a specified receiving space. In this embodiment, the specified receiving space refers to an internal space from an end of the first body 17 to first housing opening 23 (i.e., an internal space on a side connected to female connector 4 and up to an open end of the first terminal housing 11). The first terminal housing 11 and second terminal housing 12 are constructed so that the first terminal housing 11 is on the male side, and is inserted in the female second terminal housing 12.

The external surface near device-side male terminal 13 of the first terminal housing 11 is formed with a mounting sheet 15. Four corners of the mounting sheet 15 are formed with mounting holes 16 which can be used in being mounted to the device.

In this embodiment, the entire first body 17 is shown as being incorporated in the first terminal housing 11, but may be not incorporated therein. That is, for example, the first terminal housing may be attached to partially cover an end of the first body. In the case of employing this configuration, however, it is noted that mounting sheet 15 in this embodiment is preferably formed to the first body. A foreign body preventing means will be described later.

The female connector 4 will be explained below.

As shown in FIG. 5, the female connector 4 comprises three female terminals 20 (partially shown in FIG. 5) paired with the three male terminals 19, a female terminal box 21 formed with three female terminal openings 22 facing the ends of the three female terminals 20 respectively and receiving the three female terminals 20 in their respective specified receiving spaces (See FIG. 7), a second body 18 provided with the three female terminals 20 and the female terminal box 21, and a second terminal housing 12 formed with second housing opening (not shown) facing the three female terminal openings 22 and receiving the female terminal box 21 in its respective specified receiving space and incorporating the second body 18 therein.

Also, the female terminal box 21 is formed of resin, and formed with the three receiving spaces (See FIG. 7) which receive the three female terminals 20, respectively, as described later. That is, the female terminal box in this embodiment may form at least plural receiving spaces, and more specifically includes three combined female terminal box units which each form one receiving space, and which sandwich a ground sheet member therebetween. Since the female terminals 20 are provided to face the female terminal openings 22 at their ends respectively, the female terminals 20 are prevented from being touched directly with hands, so that stains such as hands' oil are prevented from adhering to the female terminals 20.

Also, the female terminals 20 are connected with electric wires 6 at one end. The electric wires 6 are excellent in thermal resistance and oil resistance, and are constructed by a central conductor (copper, or aluminum)-insulator (cross-linked polyethylene)-shield-seal. The female terminals 20 are the same as those disclosed by JP-A-2007-179987 (the same applicants as the present application).

Also, the second terminal housing 12 is cylindrically formed of a metal, e.g., aluminum, and its internal space forms a specified receiving space. In this embodiment, the specified receiving space refers to an internal space from an end of second body 18 to second housing opening (not shown, i.e., an internal space on a side connected to male connector 3 and up to an open end of the second terminal housing 12).

In this embodiment, the entire second body 18 is shown as being incorporated in the second terminal housing 12, but may be not incorporated therein. That is, the second terminal housing 12 may be attached to partially cover an end of the second body 18. Also, in this embodiment, female terminal box 21 is constructed as passing through the second body 18, but may be attached to a side of the second body 18, which both mean "the second body 18 provided with the plural female terminals 20 and female terminal box 21.

A foreign body preventing means which is an essential portion of the present invention will be explained below.

As shown in FIGS. 2 to 4, the foreign body preventing means is a specified receiving space and comprises a blocking sheet member 24 for blocking or substantially blocking first housing opening 23, and three male terminal openings 25 through which the male terminals 19 pass at specified positions respectively in the blocking sheet member 24. In operation, when the female terminal box 21 is inserted into the specified receiving space of the first terminal housing 11, the blocking member 24 is interlocked with that insertion to cause the male terminals 19 to pass through the male terminal openings 25 respectively and the blocking member 24 to slide toward the first body 17, while when the female terminal box 21 is detached from the specified receiving space of the first terminal housing 11, the blocking member 24 is interlocked with that detachment to slide toward the first housing opening 23.

The blocking sheet member 24 blocks or substantially blocks the first housing opening 23 of the first terminal housing 11, but may, as shown in FIG. 2, be formed with an air escape opening 37 for causing the air inside the first housing opening 23 of the first terminal housing 11 to escape therefrom. The air escape opening 37 may as in this embodiment be formed using a difference between the area of the first housing opening 23 and the front area of the blocking member 24, but also by forming a notch, hole or the like in the blocking member 24. Also, the blocking member 24 in this embodiment may be constructed at a size capable of blocking the first housing opening 23 more than shown in FIG. 2.

Also, the foreign body preventing means in this embodiment is further provided with a female locking means provided at both ends of the female terminal box 21 of the female connector 4 for locking the blocking member 24 of the male connector 3, and a male locking means provided at both ends of the blocking member 24 of the male connector 3 and engaged with the female locking means for locking the female terminal box 21 of the female connector 4. In operation, these locking means lock the blocking member 24 and the female terminal box 21, thereby allowing the male terminal openings 25 of the blocking member 24 and the female terminal openings 22 of the female terminal box 21 to be arranged in pairs. That arrangement allows the male terminals 19 to be inserted smoothly into the female terminal openings 22 of the female terminal box 21.

Operations of the above male and female locking means will be explained below referring to FIGS. 5 to 8.

FIG. 5 is a partially enlarged view for explaining a portion of the foreign body preventing means, and is also a partially enlarged view the male and female locking means.

The male locking means comprises a first lance 26 formed on a side of the male terminals 19 and the blocking member 24 and toward the first housing opening 23, and a first protruding portion 27 formed at an end of the first lance 26. The female locking means comprises a locking piece 29 formed with an opening 28 for engaging the first protruding portion 27, and a second protruding portion 30 for, when engaging the male locking means, bending the first lance 26 toward the locking piece 29 and causing the first protruding portion 27 to engage the opening 28. The second protruding portion 30 is substantially triangular in a plan view, and is formed with an inclined surface 38 (See FIG. 7) outwardly. Also, an inclined surface 39 (See FIG. 7) is formed on the first lance 26 side and at a position corresponding to that inclined surface 38.

The specific operation for accomplishing the engagement of the male connector 3 and the female connector 4 is shown in FIG. 8A. First, to engage the male locking means, the female terminal box 21 is inserted to insert the second protruding portion 30 between the first lance 26 and the male terminal 19. The above-mentioned two inclined surfaces 38 and 39 are for making that insertion smooth.

The insertion of the second protruding portion 30 presses and bends the first lance 26 (See FIG. 8A). The first protruding portion 27 formed on the first lance 26 is engaged with the opening 28 of the locking piece 29. With that engagement, the female terminal box 21 is further inserted toward the first body 17, to cause the male terminal 19 to pass through the male terminal opening 25, and be inserted in the female terminal opening 22. Subsequently, the female terminal box 21 is inserted up to a specified position, to complete the engagement of the male connector 3 and the female connector 4, and the electrical connection of the male terminal 19 and the female terminal 20.

When the insertion of the second protruding portion 30 presses and bends the first lance 26, a third protruding portion 31, which serves as a movement-prohibiting means to prohibiting the blocking member 24 from sliding toward the first body 17 from the end of the male terminal 19, is disengaged from the end face of the male terminal 19, i.e., the third protruding portion 31 and the end face of the male terminal 19 are unlocked. That is, the sliding of the blocking member 24 is permitted.

In this manner, the one-time bending of the first lance 26 permits the sliding of the blocking member 24, and completes the locking of the blocking member 24 and the female terminal box 21, and therefore its mechanism is compact.

Also, since the locking piece 29 is sandwiched between the first lance 26 and the inner wall of the first terminal housing 11, an excessive bending of the locking piece 29 due to a pressure acting thereon when the first lance 26 bends is prevented by the inner wall of the first terminal housing 11 which serves as a good barrier.

Also, during blocking member 24 sliding, the third protruding portion 31 formed at an end of the first lance 26 presses a side of the male terminal 19 (See FIG. 8B). This occurs at both ends of the blocking member 24, i.e., the third protruding portions 31 sandwich the plural male terminals 19 therebetween. This allows the blocking member 24 to be stably held relative to the male terminals 19, which consequently contributes to stability in the sliding.

On the other hand, the specific operation for, in the engagement of the male connector 3 and the female connector 4, removing (detaching) the female terminal box 21 from the first terminal housing 11, is shown in FIG. 8B.

That is, the first protruding portion 27 is hooked to the opening 28 of the locking piece 29, while the second protruding portion 30 is contacted with the side of the male terminal 19 and caused to slide toward the first housing opening 23, up to a slip-preventing means described later. The sliding to the slip-preventing means turns the bending of the first lance 26 back, to again lock the third protruding portion 31 to the end of the male terminal 19.

As shown in FIG. 6, the slip-preventing means is for preventing the blocking member 24 from slipping out of the end of the male terminal 19, and comprises a second lance 34 formed on the backside of the blocking member 24 and toward the first body 17, a fifth protruding portion 35 formed at an end of the second lance 34 and upright to the male terminal 19, and a sixth protruding portion 36 formed at an end of the male terminal 19 and locked with the fifth protruding portion 35.

In this embodiment, the sixth protruding portion 36 formed on the male terminal 19 is formed by processing the male terminal 19, but may also be formed otherwise. For example, the sixth protruding portion 36 may be made of another member, and attached to a specified area at an end of the male terminal 19.

Also, as shown in FIG. 7, the nearest end of the male terminal 19 is positioned on an inner side to the male terminal opening 25 of the blocking member 24.

Also, in this embodiment, the blocking member 24, first lance 26, second lance 34, first protruding portion 27, second protruding portion 30, third protruding portion 31, fourth protruding portion 33, fifth protruding portion 35, female terminal box 21, and locking piece 29 are all made of resin, but may be constructed of other materials.

Also, the foreign body preventing means in this embodiment is provided in the male connector 3 provided with male terminals with a high degree of exposure of terminals themselves, to thereby serve as a "male terminal contact-preventing means" to prevent the male terminals themselves from being touched directly with hands (fingers), so that stains such as hands' oil are prevented from adhering to the male terminals.

Advantages of the Embodiment

As described above, in this embodiment, connector 2 comprises:

device-side male connector 3 comprising plural male terminals 19 arranged substantially linearly, a first body 17 provided with the plural male terminals 19, and first terminal housing 11 formed with first housing opening 23 facing respective ends of the plural male terminals 19 and receiving the plural male terminals 19 in its specified receiving space and incorporating the first body 17 therein;

electric wire-side female connector 4 comprising plural female terminals 20 paired with the plural male terminals 19, a female terminal box 21 formed with plural female terminal openings 22 facing ends of the plural female terminals 20 respectively and receiving the plural female terminals 20 in their respective specified receiving spaces, a second body 18 provided with the plural female terminals 20 and the female terminal box 21, and a second terminal housing 12 formed with a second housing opening facing the plural female terminal openings 22 and receiving the female terminal box 21 in its respective specified receiving space and incorporating the second body 18 therein, the engagement of the male connector 3 and the female connector 4, or the first terminal housing 11 and the second terminal housing 12 electrically connecting the plural male terminals 19 and the plural female terminals 20 respectively; and foreign body preventing means for preventing a foreign body from being mixed into the specified receiving space of the first terminal housing 11, the foreign body preventing means being the specified receiving space of the first terminal housing 11 and comprising a blocking sheet member 24 for blocking or substantially blocking the first housing opening 23, and plural male terminal openings 25 through which the male terminals 19 pass at specified positions respectively in the blocking sheet member 24, wherein when the female terminal box 21 is inserted into the specified receiving space of the first terminal housing 11, the blocking member 24 is interlocked with that insertion to cause the male terminals 19 to pass through the male terminal openings 25 respectively and the blocking member 24 to slide toward the first body 17, while when the female terminal box 21 is detached from the specified receiving space of the first terminal housing 11, the blocking member 24 is interlocked with that detachment to slide toward the first housing opening 23.

Since the foreign body preventing means (blocking member) is received in the specified receiving space of the first terminal housing 11, this construction is compact. That is, it is possible to ensure a compact connector, which can contribute to the compact thereof even though the foreign body preventing means is provided.

Also, since in the foreign body preventing means, the plural male terminals 19 serve as guide rails, stable sliding is possible.

Also, the engagement of r the first terminal housing 11 and the second terminal housing 12 allows secure and stable electrical connection of the plural male terminals 19 and the plural female terminals 20.

Also, since the foreign body preventing means is provided, the male terminals 19 are prevented from being touched directly with hands, so that stains such as hands' oil are prevented from adhering to the male terminals.

Also, since the foreign body preventing means is provided in the device-side male connector 3, the invention is very effective, and has a significant technical advantage.

Also, in the connector 2 of this embodiment, the foreign body preventing means further comprises a female locking means provided at both ends of the female terminal box 21 of the female connector 4 for locking the blocking member 24 of the male connector 3, and a male locking means provided at both ends of the blocking member 24 of the male connector 3 and engaged with the female locking means for locking the female terminal box 21 of the female connector 4, the male locking means and the female locking means locking the blocking member 24 and the female terminal box 21, thereby causing the male terminal openings 25 of the blocking member 24 and the female terminal openings 22 of the female terminal box 21 to be arranged in pairs.

This construction allows synchronous sliding at both ends of the blocking member 24, and therefore smooth engagement and connection of the male connector and the female connector.

Also, in the connector 2 of this embodiment, the male locking means comprises a first lance 26 formed on a side of the blocking member 24 and toward the first housing opening 23, and a first protruding portion 27 formed at an end of the first lance 26, and the female locking means comprises a locking piece 29 formed with an opening 28 for engaging the first protruding portion 27, and a second protruding portion 30 for, when engaging the male locking means, bending the first lance 26 toward the locking piece 29 and causing the first protruding portion 27 to engage the opening 28.

This construction allows synchronous sliding at both ends of the blocking member 24, and therefore smooth engagement and connection of the male connector 3 and the female connector 4.

Also, since the first lance 26 is formed on the side of the blocking member 24, it is possible to ensure slimming the thickness of the connector 2.

Also, the connector 2 of this embodiment further comprises:

movement-prohibiting means for, prior to locking of the blocking member 24 and the female terminal box 21 by the male locking means and the female locking means, prohibiting the blocking member 24 from sliding toward the first body 17 from the end of the male terminal 19; and movement-permitting means for permitting movement of the blocking member 24 when the blocking member 24 and the female terminal box 21 are locked by the male locking means and the female locking means.

This construction allows the blocking member 24 to be securely held at the end of the male terminal 19, and the male locking means and the female locking means to be securely engaged with each other.

Also, the connector 2 of this embodiment further comprises:

movement-prohibiting means for, prior to locking of the blocking member 24 and the female terminal box 21 by the male locking means and the female locking means, prohibiting the blocking member 24 from sliding toward the first body 17 from the end of the male terminal 19; and movement-permitting means for permitting movement of the blocking member 24 when the blocking member 24 and the female terminal box 21 are locked by the male locking means and the female locking means, wherein the movement-prohibiting means comprises a third protruding portion 31 formed at an end of the first lance 26 for locking ends of the male terminals 19, and the movement-permitting means comprises a second protruding portion 30, and when engaged with the male locking means, the second protruding portion 30 bends the first lance 26 in a direction of unlocking the third protruding portion 31 and causing the first protruding portion 27 to engage the opening 28.

This construction allows the blocking member 24 to be securely held at the end of the male terminal 19, and the male locking means and the female locking means to be securely engaged with each other.

Also, the connector 2 of this embodiment further comprises:

engagement-maintaining means for maintaining engagement of the male locking means and the female locking means when the male locking means and the female locking means lock the blocking member 24 and the female terminal box 21, and the blocking member 24 is caused to slide toward the first body 17.

Since this construction maintains engagement of the male locking means and the female locking means, it is possible to cause the blocking member 24 to slide securely.

Also, the connector 2 of this embodiment further comprises:

slip-preventing means for preventing the blocking member 24 from slipping out of the ends of the male terminals 19.

This construction allows the blocking member 24 to be disengaged from the male terminals 19 when the female terminal box 21 is detached from the specified receiving space of the first terminal housing 11, so that the attachment to the male terminals 19 is eliminated.

Also, in the connector 2 of this embodiment, the slip-preventing means comprises a second lance 34 formed on the backside of the blocking member 24 and toward the first body 17, a fifth protruding portion 35 formed at an end of the second lance 34 and upright to the male terminals 19, and a sixth protruding portion 36 formed at ends of the male terminals 19 and locked with the fifth protruding portion 35.

This construction allows the blocking member 24 to be disengaged from the male terminals 19 when the female terminal box 21 is detached from the specified receiving space of the first terminal housing 11, so that the attachment to the male terminals 19 is eliminated.

Also, in the connector 2 of this embodiment, the farthest ends of the male terminals 19 are positioned on an inner side to the male terminal opening 25 of the blocking member 24 before the female terminal box 21 is inserted into the specified receiving space of the first terminal housing 11, and when the blocking member 24 is positioned at the ends of the male terminals 19.

This construction allows the male terminals 19 to be prevented from being touched directly with hands from the male terminal opening 25, so that stains such as hands' oil are prevented from adhering to the male terminals 19.

Also, the connector 2 of this embodiment further comprises:

an air escape opening 37 for causing the air inside the specified receiving space of the first terminal housing 11 to escape therefrom when the blocking member 24 blocks or substantially blocks the first housing opening 23.

This construction allows the heat inside the specified receiving space of the first terminal housing 11 to escape therefrom. In that case, it is desirable that the air escape opening 37 be formed to be positioned on an upper side.

Modification to the Embodiment

The above embodiment uses a "triple-pole connector," but the invention may apply to a "monopole connector." Namely, it may be a connector comprising:

a male connector comprising a male terminal arranged substantially linearly, a first body provided with the male terminal, and a first terminal housing formed with a first housing opening facing an end of the male terminal and receiving the male terminal in its specified receiving space and incorporating the first body therein;

a female connector comprising a female terminal paired with the male terminal, a female terminal box formed with a female terminal opening facing an end of the female terminal and receiving the female terminal in its specified receiving space, a second body provided with the female terminal and the female terminal box, and a second terminal housing formed with a second housing opening facing the female terminal opening and receiving the female terminal box in its specified receiving space and incorporating the second body therein, the engagement of the male connector and the female connector, or the first terminal housing and the second terminal housing electrically connecting the male terminal and the female terminal; and foreign body preventing means for preventing a foreign body from being mixed into the specified receiving space of the first terminal housing, the foreign body preventing means being the specified receiving space of the first terminal housing and comprising a blocking sheet member for blocking or substantially blocking the first housing opening, and a male terminal opening through which the male terminal passes at a specified position in the blocking sheet member, wherein when the female terminal box is inserted into the specified receiving space of the first terminal housing, the blocking member is interlocked with that insertion to cause the male terminal to pass through the male terminal opening and the blocking member to slide toward the first body, while when the female terminal box is detached from the specified receiving space of the first terminal housing, the blocking member is interlocked with that detachment to slide toward the first housing opening.

Although the invention has been described with respect to the specific embodiment for complete and clear disclosure, the appended claims are not to be thus limited but are to be construed as embodying all modifications and alternative constructions that may be occurred to one skilled in the art which fairly fall within the basic teaching herein set forth.

What is claimed is:

1. A connector, comprising:

a male connector comprising a male terminal arranged substantially linearly, a first body provided with the male terminal, and a first terminal housing formed with a first housing opening facing an end of the male terminal and receiving the male terminal in its specified receiving space and incorporating the first body therein;

a female connector comprising a female terminal paired with the male terminal, a female terminal box formed with a female terminal opening facing an end of the female terminal and receiving the female terminal in its specified receiving space, and a second body provided with the female terminal and the female terminal box, the engagement of the male connector and the female connector, or the first terminal housing and the second terminal housing electrically connecting the male terminal and the female terminal;

foreign body preventing means for preventing a foreign body from being mixed into the specified receiving space of the first terminal housing, the foreign body preventing means comprising a blocking sheet member enclosed in the specified receiving space of the first terminal housing for blocking or substantially blocking the first housing opening, and a male terminal opening through which the male terminal passes at a specified position in the blocking sheet member, wherein when the female terminal box is inserted into the specified receiving space of the first terminal housing, the blocking sheet member is interlocked with that insertion to cause the male terminal to pass through the male terminal opening and the blocking sheet member to slide toward the first body, while when the female terminal box is detached from the specified receiving space of the first terminal housing, the blocking sheet member is interlocked with that detachment to slide toward the first housing opening, and wherein the foreign body preventing means further comprises female locking means provided at both ends of the female terminal box of the female connector for locking the blocking sheet member of the male connector, and male locking means provided at both ends of the blocking sheet member of the male connector and engaged with the female locking means for locking the female terminal box of the female connector, the male locking means and the female locking means locking the blocking sheet member and the female terminal box, thereby causing the male terminal openings of the blocking sheet member and the female terminal openings of the female terminal box to be arranged in pairs.

2. The connector according to claim 1, wherein the male terminal comprises a plurality of male terminals, and the female terminal comprises female terminals of the same number as the plurality of male terminals.

3. The connector according to claim 1, further comprising:

movement-prohibiting means for, prior to locking of the blocking sheet member and the female terminal box by the male locking means and the female locking means, prohibiting the blocking sheet member from sliding toward the first body from the end of the male terminal; and movement-permitting means for permitting movement of the blocking sheet member when the blocking sheet member and the female terminal box are locked by the male locking means and the female locking means.

4. The connector according to claim 1, further comprising:

engagement-maintaining means for maintaining engagement of the male locking means and the female locking means when the male locking means and the female locking means lock the blocking sheet member and the female terminal box, and the blocking sheet member is caused to slide toward the first body.

5. The connector according to claim 1, wherein the farthest ends of the male terminals are positioned on an inner side to the male terminal opening of the blocking sheet member before the female terminal box is inserted into the specified receiving space of the first terminal housing, and when the blocking sheet member is positioned at the ends of the male terminals.

6. The connector according to claim 1, further comprising:

an air escape opening for causing the air inside the specified receiving space of the first terminal housing to escape therefrom when the blocking sheet member blocks or substantially blocks the first housing opening.

the third protruding portion and causing the first protruding portion to engage the opening.

7. The connector according to claim 1, wherein the male locking means comprises a first lance formed on a side of the blocking sheet member and toward the first housing opening, and a first protruding portion formed at an end of the first lance, and the female locking means comprises a locking piece formed with an opening for engaging the first protruding portion, and a second protruding portion for, when engaging the male locking means, bending the first lance toward the locking piece and causing the first protruding portion to engage the opening.

8. The connector according to claim 7, further comprising:

movement-prohibiting means for, prior to locking of the blocking sheet member and the female terminal box by the male locking means and the female locking means, prohibiting the blocking sheet member from sliding toward the first body from the end of the male terminal; and movement-permitting means for permitting movement of the blocking sheet member when the blocking sheet member and the female terminal box are locked by the male locking means and the female locking means, wherein the movement-prohibiting means comprises a third protruding portion formed at an end of the first lance for locking ends of the male terminals, and the movement-permitting means comprises a second protruding portion, and when engaged with the male locking means, the second protruding portion bends the first lance in a direction of unlocking the third protruding portion and causing the first protruding portion to engage the opening.

9. The connector according to claim 8, wherein the slip-preventing means comprises a second lance formed on the backside of the blocking sheet member and toward the first body, a fifth protruding portion formed at an end of the second lance and upright to the male terminals, and a sixth protruding portion formed at the ends of the male terminals and locked with the fifth protruding portion.

10. The connector according to claim 1, wherein the farthest ends of the male terminals are positioned on an inner side to the male terminal opening of the blocking sheet member before the female terminal box is inserted into the specified receiving space of the first terminal housing, and when the blocking sheet member is positioned at the ends of the male terminals.

* * * * *